US009026435B2

(12) United States Patent
Krini et al.

(10) Patent No.: US 9,026,435 B2
(45) Date of Patent: May 5, 2015

(54) METHOD FOR ESTIMATING A FUNDAMENTAL FREQUENCY OF A SPEECH SIGNAL

(75) Inventors: Mohamed Krini, Ulm (DE); Gerhard Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 680 days.

(21) Appl. No.: 12/772,562

(22) Filed: May 3, 2010

(65) Prior Publication Data

US 2010/0286981 A1 Nov. 11, 2010

(30) Foreign Application Priority Data

May 6, 2009 (EP) ..... 09006188

(51) Int. Cl.
*G10L 19/09* (2013.01)
*G10L 25/90* (2013.01)
*G10L 21/0216* (2013.01)

(52) U.S. Cl.
CPC ..... *G10L 25/90* (2013.01); *G10L 2021/02168* (2013.01)

(58) Field of Classification Search
CPC ..... G10L 25/90; G10L 2021/02168; G10L 25/93; G10L 19/093; G10L 19/265; G10L 21/0272; G10L 25/18; G10L 25/30; G10L 2021/02165; G10L 2021/065; G10L 21/0208; G10L 2021/02161; G10L 21/0205; G10L 21/0216; G10L 21/0264; G10L 25/06; G10L 25/12; G10L 25/21; G10L 25/54; G10L 25/78; G10L 25/84
USPC ..... 704/203, 233, 226, 263, 264, 208, 209, 704/E19.03, E21.012, 205–207, 216–218, 704/237, 250, 251, 255, 256, 256.1, 268
See application file for complete search history.

(56) References Cited

U.S. PATENT DOCUMENTS 5,400,409 A * 3/1995 Linhard ..... 381/92
5,479,517 A * 12/1995 Linhard ..... 381/94.7
5,890,108 A * 3/1999 Yeldener ..... 704/208
6,377,916 B1 * 4/2002 Hardwick ..... 704/208

(Continued)

FOREIGN PATENT DOCUMENTS

EP 1 944 754 A1 7/2008 ..... G10L 11/04

OTHER PUBLICATIONS

Klapuri "Multiple Fundamental Frequency Estimation Based on Harmonicity and Spectral Smoothness", Speech and Audio Processing, IEEE Transactions on (vol. 11 , Issue: 6 ). Nov. 2003, pp. 804-816.*

(Continued)

*Primary Examiner* — Abdelali Serrou
(74) *Attorney, Agent, or Firm* — Daly, Crowley, Mofford & Durkee, LLP

(57) ABSTRACT

The invention provides a method for estimating a fundamental frequency of a speech signal comprising the steps of receiving a signal spectrum of the speech signal, filtering the signal spectrum to obtain a refined signal spectrum, determining a cross-power spectral density using the refined signal spectrum and the signal spectrum, transforming the cross-power spectral density into the time domain to obtain a cross-correlation function, and estimating the fundamental frequency of the speech signal based on the cross-correlation function.

27 Claims, 10 Drawing Sheets

(56) References Cited

U.S. PATENT DOCUMENTS

| | | | | |
|---|---|---|---|---|
| 6,725,108 | B1 * | 4/2004 | Hall | 700/94 |
| 7,013,266 | B1 * | 3/2006 | Berger | 704/203 |
| 7,565,288 | B2 * | 7/2009 | Acero et al. | 704/226 |
| 7,711,553 | B2 * | 5/2010 | Nam | 704/201 |
| 7,813,923 | B2 * | 10/2010 | Acero et al. | 704/233 |
| 8,238,575 | B2 * | 8/2012 | Buck et al. | 381/94.1 |
| 8,712,770 | B2 * | 4/2014 | Fukuda et al. | 704/233 |
| 2003/0108214 | A1 * | 6/2003 | Brennan et al. | 381/94.7 |
| 2005/0071156 | A1 * | 3/2005 | Xu et al. | 704/226 |
| 2006/0036435 | A1 * | 2/2006 | Kovesi et al. | 704/229 |
| 2006/0083407 | A1 * | 4/2006 | Zimmermann et al. | 382/107 |
| 2007/0225971 | A1 * | 9/2007 | Bessette | 704/203 |
| 2007/0280472 | A1 * | 12/2007 | Stokes III et al. | 379/406.01 |
| 2008/0031468 | A1 * | 2/2008 | Christoph et al. | 381/71.2 |
| 2008/0062043 | A1 * | 3/2008 | Gezici et al. | 342/387 |
| 2008/0103761 | A1 * | 5/2008 | Printz et al. | 704/9 |
| 2008/0159559 | A1 * | 7/2008 | Akagi et al. | 381/92 |
| 2008/0208570 | A1 * | 8/2008 | Nam | 704/201 |
| 2008/0306745 | A1 * | 12/2008 | Roy et al. | 704/500 |
| 2009/0112607 | A1 * | 4/2009 | Ashley et al. | 704/500 |
| 2009/0254342 | A1 * | 10/2009 | Buck et al. | 704/233 |
| 2009/0291632 | A1 * | 11/2009 | Braithwaite et al. | 455/7 |

OTHER PUBLICATIONS

Pertusa "Multiple Fundamental Frequency Estimation Using Gaussian Smoothness", Acoustics, Speech and Signal Processing, 2008. ICASSP 2008. IEEE International Conference on Mar. 31, 2008-Apr. 4, 2008, pp. 105-108.*

Mohamed, K., et al., "Spectral Refinement and its Applications to Fundamental Frequency Estimation," *IEEE*, Oct. 1, 2007, pp. 251-254.

Quast, H., et al., "Robust Pitch Tracking in the Car Environment," *IEEE*, vol. 1, May 13, 2002, pp. I-353-I-356.

European Patent Office—Examiner Norbert Greiser, Extended European Search Report, Application No. 09006188.8-2225; Sep. 24, 2009.

European Application No. 09 006 188.8 Intention to Grant dated Mar. 13, 2014, 10 pages.

European Patent Application No. 09006188.8-1910/2249333 Decision to grant a European Patent dated Jul. 31, 2014 1 page.

* cited by examiner

METHOD FOR ESTIMATING A FUNDAMENTAL FREQUENCY OF A SPEECH SIGNAL

PRIORITY

The present U.S. patent application claims priority from European Patent Application No. 09006188.8 filed on May 6, 2009 entitled "Method for Estimating a Fundamental Frequency of a Speech Signal," which is incorporated herein by reference in its entirety.

TECHNICAL FIELD

The present invention relates to a method for estimating a fundamental frequency of a speech signal.

BACKGROUND ART

The distance between two subsequent amplitude peaks corresponds to the fundamental frequency of the speech signal.

Estimating a fundamental frequency is an important issue of many applications relating to speech signal processing, for instance, for automatic speech recognition or speech synthesis. The fundamental frequency may be estimated, for example, for an impaired speech signal. Based on the fundamental frequency estimate, an undisturbed speech signal may be synthesized. In another example, the fundamental frequency estimate may be used to improve the recognition accuracy of a system for automatic speech recognition.

Several methods for estimating the fundamental frequency of a speech signal are known. One method, for example, is based on an harmonic product spectrum (see, e.g., M. R. Schroeder, "Period Histogram and Product Spectrum: New methods for fundamental frequency measurements", in Journal of the Acoustical Society of America, vol. 43, no. 4, 1968, pages 829 to 834).

Another class of methods is based on an analysis of the auto-correlation function of the speech signal (e.g. A. de Cheveigne, H. Kawahara, "Yin, a Fundamental Frequency Estimator for Speech and Music", JASA, 2002, 111(4), pages 1917-1930). The auto-correlation function has a maximum at a lag associated with the fundamental frequency.

Methods based on the auto-correlation function, however, often encounter problems estimating low fundamental frequencies, as they can occur for male speakers. Methods to overcome this problem are hitherto either computationally inefficient or introduce a significant delay.

SUMMARY OF THE INVENTION

According to a first embodiment of the present invention, a method for estimating a fundamental frequency of a speech signal requires receiving a signal spectrum of a speech signal. The signal spectrum is refined to obtain a refined signal spectrum. A cross-power spectral density is determined using the refined signal spectrum and the signal spectrum. The cross-power spectral density is transformed into the time domain to obtain a cross-correlation function. The fundamental frequency of the speech signal is then estimated based on the cross-correlation function.

By determining a cross-correlation function between a signal spectrum and a refined or augmented signal spectrum, the amount of information in the cross-correlation function can be increased. In this way, the fundamental frequency of the speech signal can be estimated robustly and accurately, also for low fundamental frequencies.

The fundamental frequency may correspond to the lowest frequency component, lowest frequency partial or lowest frequency overtone of the speech signal. In particular, the fundamental frequency may correspond to the rate of vibrations of the vocal folds or vocal chords. The fundamental frequency may correspond to or be related to the pitch or pitch frequency. A speech signal may be periodic or quasi-periodic. In this case, the fundamental frequency may correspond to the inverse of the period of the speech signal, in particular wherein the period may correspond to the smallest positive time shift that leaves the speech signal invariant. A quasi-periodic speech signal may be periodic within one or more segments of the speech signal but not for the complete speech signal. In particular, a quasi-periodic speech signal may be periodic up to a small error.

The fundamental frequency may correspond to a distance in frequency space between amplitude peaks of the spectrum of the speech signal. The fundamental frequency depends on the speaker. In particular, the fundamental frequency of a male speaker may be lower than the fundamental frequency of a female speaker or of a child.

The signal spectrum may correspond to a frequency domain representation of the speech signal or of a part or segment of the speech signal. The signal spectrum may correspond to a Fourier transform of the speech signal, in particular, to a Fast Fourier Transform (FFT) or a short-time Fourier transform of the speech signal. In other words, the signal spectrum may correspond to an output of a short-time or short-term frequency analysis.

The signal spectrum may be a discrete spectrum, i.e. specified at predetermined frequency values or frequency nodes.

The signal spectrum of the speech signal may be received from a system or an apparatus used for speech signal processing, for example, from a hands-free telephone set or a voice control, i.e. a voice command device. In this way, the efficiency of the method can be improved, as it uses input generated by another system.

Prior to receiving the signal spectrum, the signal spectrum may be determined by transforming the speech signal into the frequency domain. In particular, determining a signal spectrum may comprise processing the speech signal using a window function. Determining a signal spectrum may comprise performing a Fourier transform, in particular a discrete Fourier transform, in particular a Fast Fourier Transform or a short-time Fourier transform.

A refined signal spectrum may comprise an increased number of discrete frequency nodes compared to the signal spectrum. In other words, a refined signal spectrum may correspond to a frequency domain representation of the speech signal with an increased spectral resolution compared to the signal spectrum.

The signal spectrum and the refined signal spectrum may correspond to a predetermined sub-band or frequency band. In particular, the signal spectrum and the refined signal spectrum may correspond to sub-band spectra, in particular to sub-band short-time spectra.

By filtering the signal spectrum the method allows for a computationally efficient method to obtain a refined signal spectrum. In particular, filtering the signal spectrum may be computationally less expensive than determining a higher order Fourier transform of the speech signal to obtain a refined signal spectrum. Alternatively, however, a refined signal spectrum may be obtained by transforming the speech signal into the frequency domain, in particular using a Fourier transform.

Filtering the signal spectrum may be performed using a finite impulse response (FIR) filtering module. This guarantees a linear phase response and stability. Filtering the signal spectrum may be performed such that an algebraic mapping of the signal spectrum to a refined signal spectrum is realized. In particular, the step of filtering the signal spectrum may comprise combining the signal spectrum with one or more time delayed signal spectra, wherein a time delayed signal spectrum corresponds to a signal spectrum of the speech signal at a previous time.

Filtering the signal spectrum may comprise a time-delay filtering of the signal spectrum. The refined signal spectrum may correspond to a time delayed signal spectrum. In this case, the delay used for time-delay filtering of the signal spectrum may correspond to the group delay of the filtering module used for filtering the signal spectrum.

In the above-described methods the cross-power spectral density of the refined signal spectrum and the signal spectrum is determined. The step of determining the cross-power spectral density may comprise determining the complex conjugate of the refined signal spectrum or of the signal spectrum and determining a product of the complex conjugate of the refined signal spectrum and the signal spectrum or a product of the complex conjugate of the signal spectrum and the refined signal spectrum. The cross-power spectral density may be a complex valued function. The cross-power spectral density may correspond to the Fourier transform of a cross-correlation function.

The cross-power spectral density may be a discrete function, in particular specified at predetermined sampling points, i.e. for predetermined values of a frequency variable.

Transforming the cross-power spectral density into the time domain may be preceded by smoothing and/or normalizing the cross-power spectral density. In particular, the cross-power spectral density may be normalized based on a smoothed cross-power spectral density to obtain a normalized cross-power spectral density. In this way, the envelope of the cross-power spectral density may be cancelled.

Normalizing the cross-power spectral density may be based on an absolute value of the determined cross-power spectral density. In particular, the cross-power spectral density may be normalized using a smoothed cross-power spectral density, in particular, wherein the smoothed cross-power spectral density may be determined based on an absolute value of the cross-power spectral density.

The normalized cross-power spectral density may be weighted using a power spectral density weight function. In this way, predetermined frequency ranges may be associated with a higher statistical weight. Thus, the estimation of the fundamental frequency may be improved, as the fundamental frequency of a speech signal is usually found within a predetermined frequency range. For example, the power spectral density weight function may be chosen such that its value decreases with increasing frequency. In this way, the estimation of low fundamental frequencies may be improved.

Transforming the cross-power spectral density into the time domain may comprise an Inverse Fourier transform, in particular, an Inverse Fast Fourier transform. When using an Inverse Fast Fourier Transform, the required computing time may be further reduced. By transforming the cross-power spectral density into the time domain, a cross-correlation function can be obtained.

The cross-correlation function is a measure of the correlation between two functions, in particular between two wave fronts of the speech signal. In particular, the cross-correlation function is a measure of the correlation between two time dependent functions as a function of an offset or lag (e.g. a time-lag) applied to one of the functions.

Estimating the fundamental frequency may comprise determining a maximum of the cross-correlation function. In particular, estimating the fundamental frequency may comprise determining a maximum of the cross-correlation function in a predetermined range of lags. By determining a maximum of the cross-correlation function in a predetermined range of lags, knowledge on a possible range of fundamental frequencies can be considered. In this way, the fundamental frequency can be estimated more efficiently, in particular faster, than when considering the complete available frequency space. The determined maximum may correspond to a local maximum, in particular, to the second highest maximum after the global maximum.

Estimating the fundamental frequency may further comprise compensating for a shift or delay of the cross-correlation function introduced by filtering the signal spectrum. Due to filtering of the signal spectrum, the cross-correlation function may have a maximum value at a lag corresponding to the group delay of the employed filter. The cross-correlation function may be corrected such that a signal with a predetermined period has a maximum in the cross-correlation function at a lag of zero and at lags which correspond to integer multiples of the period of the signal. In this way, the cross-correlation function comprises similar properties as an auto-correlation function. In this way, estimating the fundamental frequency may be simplified.

In particular, in this case, the step of determining a maximum of the cross-correlation function may correspond to determining the highest non-zero lag peak of the cross-correlation function.

Estimating the fundamental frequency may comprise determining a lag of the cross-correlation function corresponding to the determined maximum of the cross-correlation function. This lag may correspond to or be proportional to the period of the speech signal. In particular, the fundamental frequency may be proportional to the inverse of the lag associated with the determined maximum of the cross-correlation function.

The speech signal may be a discrete or sampled speech signal. Estimating the fundamental frequency may be further based on the sampling rate of the sampled speech signal. In this way, the fundamental frequency may be expressed in physical units. In particular, the fundamental frequency may be estimated by determining the product of the sampling rate and the inverse of the lag associated with the determined maximum of the cross-correlation function. In this case, the lag may be dimensionless, in particular corresponding to a discrete lag variable of the cross-correlation function.

The step of estimating the fundamental frequency may comprise determining a weight function for the cross-correlation function. The weight function may be a discrete function. Similarly, the cross-correlation function may be a discrete function, which is specified for a predetermined number of sampling points. Each sampling point may correspond to a predetermined value of a lag variable. The weight function may be evaluated for the same number of sampling points, in particular for the same values of the lag variable, thereby obtaining a set of weights. The set of weights may form a weight vector. Each weight of the set of weights may correspond to a sampling point of the cross-correlation function. In other words, for each sampling point of the cross-correlation function a weight may be determined from the weight function.

Estimating the fundamental frequency may comprise weighting the cross-correlation function using the determined weight function or using the determined set of weights. In this way, the accuracy and/or the reliability of the fundamental frequency estimation may be further enhanced.

The weight function may comprise a bias term, a mean fundamental frequency term and/or a current fundamental frequency term.

The bias term may compensate for a bias of the estimation of the fundamental frequency. In particular, the bias term may compensate for a bias of the cross-correlation function. A bias may correspond to a difference between an estimated value of a parameter, for example, the fundamental frequency or a value of the cross-correlation function at a predetermined lag, and the true value of the parameter.

Determining a bias term of the weight function may be based on one or more cross-correlation functions of correlated white noise.

In particular, determining the bias term may comprise determining a cross-correlation function for each of a plurality of frames of correlated white noise, determining a time average of the cross-correlation functions, and determining the weight function based on the time average of the cross-correlation functions. In this way, a bias term compensating for a bias of the fundamental frequency estimation may be determined. In particular, the cross-correlation functions may be determined for Gaussian distributed white noise. The white noise may be correlated. The correlated white noise may be sub-band coded and/or short-time Fourier transformed, in particular, to obtain short time spectra of the white noise associated with the plurality of frames.

In particular, determining a cross-correlation function of correlated white noise may comprise receiving a spectrum of the correlated white noise, filtering the spectrum to obtain a refined spectrum, determining a cross-power spectral density of the spectrum and the refined spectrum, and transforming the cross-power spectral density into the time domain to obtain a cross-correlation function. In this way, the cross-correlation function may be determined in a similar way as the one obtained from the signal spectrum of the speech signal and the refined signal spectrum.

Determining a cross-correlation function may further comprise sampling the correlated white noise and filtering a short time spectrum associated with the correlated white noise, in particular using a predetermined frame shift.

Determining a time average of the cross-correlation functions may comprise averaging over cross-correlation functions determined for a plurality of frames of the correlated white noise. The number of frames used for determining the time average may be determined based on a predetermined criterion. The predetermined criterion for the time average may be based on the predetermined frame shift and/or the sampling rate of the correlated white noise.

Determining the bias term based on the time average of the cross-correlation functions may comprise determining a minimum of a predetermined maximum value and the value of the time average of the cross-correlation functions at a given lag, in particular, normalized to the value of the time average of the cross-correlation at a lag of zero.

The speech signal may comprise a sequence of frames, and the signal spectrum may be a signal spectrum of a frame of the speech signal. In this way, a fundamental frequency can be estimated for a part of the speech signal. The sequence of frames may correspond to a consecutive sequence of frames, in particular, wherein frames from the sequence of frames are subsequent or adjacent in time.

Determining a mean fundamental frequency term of the weight function may be based on a mean fundamental frequency, in particular, on a mean lag associated with the mean fundamental frequency. In this way, predetermined values of the lag of the cross-correlation function may be favoured or enhanced.

In particular, the mean fundamental frequency term may be constant for a predetermined range of lags comprising the mean lag. The predetermined range may be symmetric with respect to the mean lag. For lag values outside the predetermined range, the mean fundamental frequency teen may take values smaller than for lag values inside the predetermined range. In particular, for lag values outside the predetermined range the mean fundamental frequency term of the weight function may decrease, in particular linearly. In this way, the cross-correlation function for values of the lag close to the mean lag, i.e. within the predetermined range, get a higher statistical weight. The mean fundamental frequency term may be bounded below. In this way, the mean fundamental frequency term cannot take values below a predetermined lower threshold. This may be particularly useful, if the mean fundamental frequency is a bad estimate for the fundamental frequency of the speech signal, in particular for the frame for which the fundamental frequency is being estimated.

Determining a current fundamental frequency term of the weight function may be based on a predetermined fundamental frequency, in particular, on a predetermined lag associated with the predetermined fundamental frequency. In this way, values of the lag close to the predetermined lag associated with a predetermined or current fundamental frequency may be associated with a higher statistical weight. The predetermined fundamental frequency may be, in particular, associated with a previous frame of the frame for which the fundamental frequency is being estimated. In particular, the previous frame may be the previous adjacent frame.

In particular, the current fundamental frequency term may be constant, in particular 1, for a predetermined range of lags comprising the predetermined lag. The predetermined range may be symmetric with respect to the predetermined lag. For lag values outside the predetermined range, the current fundamental frequency term may take values smaller than for lag values inside the predetermined range. In particular, for lag values outside the predetermined range the current fundamental frequency term of the weight function may decrease, in particular linearly. In this way, the cross-correlation function for values of the lag close to the predetermined lag, i.e. within the predetermined range, get a higher statistical weight. The current fundamental frequency term may be bounded below. In this way, the current fundamental frequency term cannot take values below a predetermined lower threshold. This may be particularly useful, if the predetermined fundamental frequency is a bad estimate for the fundamental frequency of the speech signal, in particular for the frame for which the fundamental frequency is being estimated.

Determining the weight function may comprise determining a combination, in particular a product, of at least two terms of the group of terms comprising a current fundamental frequency term, a mean fundamental frequency term and a bias term.

Estimating the fundamental frequency may comprise determining a confidence measure for the estimated fundamental frequency. In this way, the reliability of the estimation may be quantified. This may be particularly useful for applications using the estimate of the fundamental frequency, for example, methods for speech synthesis. Depending on the value of the confidence measure, such applications may adopt the fundamental frequency estimate or modify a fundamental frequency parameter according to a predetermined criterion.

The confidence measure may be determined based on the cross-correlation function, in particular, based on a normalized cross-correlation function. In particular, the confidence measure may correspond to the ratio of the value of the cross-correlation function, which has been compensated for a shift introduced by filtering the signal spectrum, at a lag associated with the determined maximum and a value of the cross-correlation function at a lag of zero. In this case, higher values of the confidence measure may indicate a more reliable estimate.

Filtering the signal spectrum may comprise augmenting the number of frequency nodes of the signal spectrum such that the number of frequency nodes of the refined signal spectrum is greater than the number of frequency nodes of the signal spectrum. Filtering may be performed using an FIR filter.

In particular, filtering the signal spectrum may comprise time-delay filtering the signal spectrum, in particular, using an FIR filter.

The speech signal may comprise a sequence of frames, and the steps of one of the above-described methods may be performed for the signal spectrum of each frame of the speech signal or for the signal spectrum of a plurality of frames of the speech signal.

In particular, a method for estimating a fundamental frequency of a speech signal, wherein the speech signal comprises a sequence of frames, may comprise for each frame of the sequence of frames or for each frame of a plurality of frames receiving a signal spectrum of the frame. The frame may then be filtered. The filtering may be used to increase the spectral resolution of the signal spectrum. A cross-power spectral density can then be determined based upon the signal spectrum and the filtered signal spectrum. The cross-power spectral density is then transformed into the time domain. Finally, the fundamental frequency of the frame can be estimated based upon the time domain cross-power spectral density.

In this way, a temporary evolution of the fundamental frequency may be determined and/or the fundamental frequency may be estimated for a plurality of parts of the speech signal. This may be particularly relevant if the fundamental frequency shows variations in time. A frame may correspond to a part or a segment of the speech signal.

The sequence of frames may correspond to a consecutive sequence of frames, in particular, wherein frames from the sequence of frames are subsequent or adjacent in time.

Estimating the fundamental frequency of the speech signal may comprise averaging over the estimates of the fundamental frequency of individual frames of the speech signal, thereby obtaining a mean fundamental frequency.

The speech signal may comprise a sequence of frames for one or more sub-bands or frequency bands, and the steps of one of the above-described methods may be performed for the signal spectrum of a frame or of a plurality of frames of one or more sub-bands of the speech signal. For one or more predetermined sub-bands, the refined signal spectrum may correspond to a time delayed signal spectrum.

A signal spectrum for each frame may be determined using short-time Fourier transforms of the speech signal. For this purpose, the speech signal is multiplied with a window function and the Fourier transform is determined for the window.

A frame or a window of the speech signal may be obtained by applying a window function to the speech signal. In particular, a sequence of frames may be obtained by processing the speech signal using a plurality of window functions, wherein the window functions are shifted with respect to each other in time. The shift between each pair of window functions may be constant. In this way, frames equidistantly spaced in time may be obtained.

The invention may provide a method for setting a fundamental frequency value or fundamental frequency parameter, wherein the fundamental frequency of a speech signal is estimated as described above, and wherein a fundamental frequency parameter is set to the estimated fundamental frequency if a confidence measure exceeds a predetermined threshold. In particular, the fundamental frequency parameter may be set to the mean fundamental frequency. Otherwise, if the confidence measure does not exceed the predetermined threshold, the fundamental frequency value may be set to a preset value or set to a value indicating a non-detectable fundamental frequency.

The invention further provides a computer program product, comprising one or more computer-readable media, having computer executable instructions for performing the steps of one of the above-described methods, when run on a computer.

The invention further provides an apparatus for estimating a fundamental frequency of a speech signal. The apparatus includes a receiver configured to receive a signal spectrum of the speech signal and a filter configured to filter the signal spectrum to obtain a refined signal spectrum. The apparatus further includes a cross-power spectral density module for determining a cross-power spectral density using the refined signal spectrum and the signal spectrum. A transformation module receives and transforms the cross-power spectral density into the time domain to obtain a cross-correlation function. The cross-correlation function is provided to a fundamental frequency module that is configured to estimate the fundamental frequency of the speech signal based on the cross-correlation function.

The invention further provides a system, in particular, a hands-free system, comprising an apparatus as described above. In particular, the hands-free system may be a hands-free telephone set or a hands-free speech control system, in particular, for use in a vehicle.

The system may comprise a speech processor configured to perform noise reduction, echo cancelling, speech synthesis or speech recognition. The system may comprise a transformation module configured to transform the speech signal into one or more signal spectra. In particular, the transformation module may comprise a Fast Fourier transformation module for performing a Fast Fourier Transform or a short-time Fourier transformation module for performing a short-time Fourier Transform.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions

As used in this description and the accompanying claims, the following terms shall have the meanings indicated, unless the context otherwise requires: The term "module" shall apply to software embodiments, hardware embodiments, or a combination of software and hardware. Software embodiments include computer executable instructions, wherein the instructions may be performed by a processor and the instructions may be embodied on computer readable storage medium. A "hardware module" shall include both hardware (circuitry) embodiments and hardware (e.g. processors, application specific integrated circuits etc.) that are programmed with software stored in memory.

Figure 7:
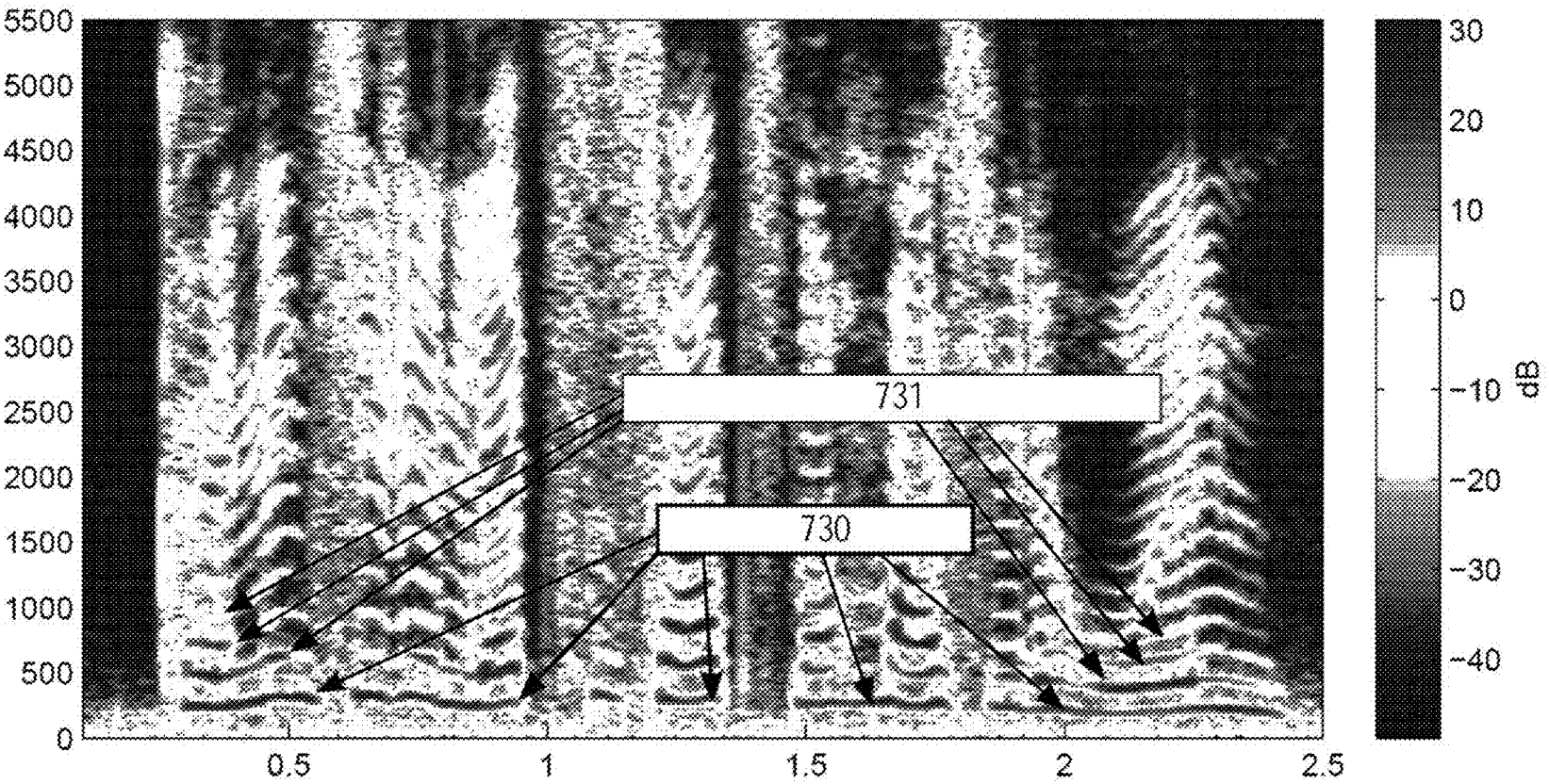
FIG. 7 shows a spectrogram of a speech signal.

The spectrum of a voiced speech signal or of a segment of the voiced speech signal, may comprise amplitude peaks equidistantly distributed in frequency space. FIG. 7 shows a spectrogram, i.e. a time-frequency analysis, of a speech signal. The x-axis shows the time in seconds and the y-axis shows the frequency in Hz. In this Figure the difference in frequency between two amplitude peaks corresponds to the fundamental frequency of the speech signal. The amplitude peaks 731 correspond to frequency partials or frequency overtones of the speech signal. In particular, the fundamental frequency 730 is shown as the lowest frequency partial or lowest frequency overtone of the speech signal. The value of the fundamental frequency or pitch frequency depends on the speaker. For men, the fundamental frequency usually varies between 80 Hz and 150 Hz. For women and children, the fundamental frequency varies between 150 Hz and 300 Hz for women and between 200 Hz and 600 Hz for children, respectively. Especially, the detection of low fundamental frequencies, as they can occur for male speakers, can be difficult.

Figure 6:
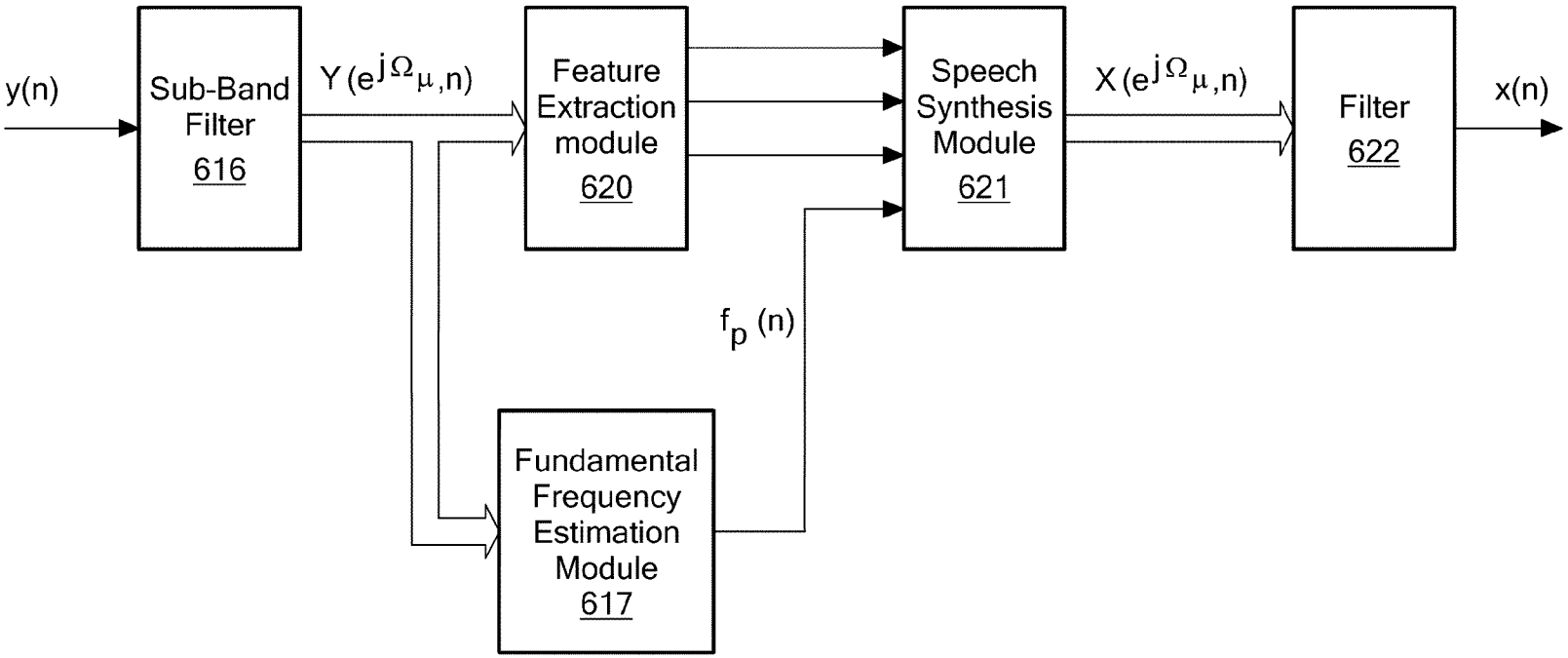
FIG. 6 shows an example for an application of a fundamental frequency estimation.

An estimation of the fundamental frequency of a speech signal can be necessary in many different applications. FIG. 6 shows an example for an application of a method for estimating a fundamental frequency. In particular, FIG. 6 shows a system for speech synthesis, in particular, for reconstructing an undisturbed speech signal (see e.g. "Model-based Speech Enhancement" by M. Krini and G. Schmidt, in E. Hänsler, G. Schmidt (eds.), Topics in Speech and Audio Processing in Adverse Environments, Berlin, Springer, 2008). For such an application, it is often required to provide a reliable estimate of the fundamental frequency which does not introduce a signal delay. Additionally, a computationally efficient method may be required, as the fundamental frequency should be estimated in real time.

In particular, FIG. 6 shows filtering module 616 for converting an impaired speech signal, y(n), into sub-band short-time spectra, $Y(e^{j\Omega_\mu},n)$. Here and in the following the parameter n denotes a time variable, in particular a discrete time variable. A fundamental frequency estimating apparatus 617 yields an estimate of the fundamental frequency of the impaired speech signal. Further features of the speech signal may be extracted by feature extraction module 620. The speech synthesis module 621 uses the information obtained from the fundamental frequency estimating apparatus 617 and the feature extraction module 620 to determine a synthesized short-time spectrum, $X(e^{j\Omega_\mu},n)$. Filtering module 622 converts the synthesized short-time spectrum into an undisturbed output signal, x(n).

Figure 5:
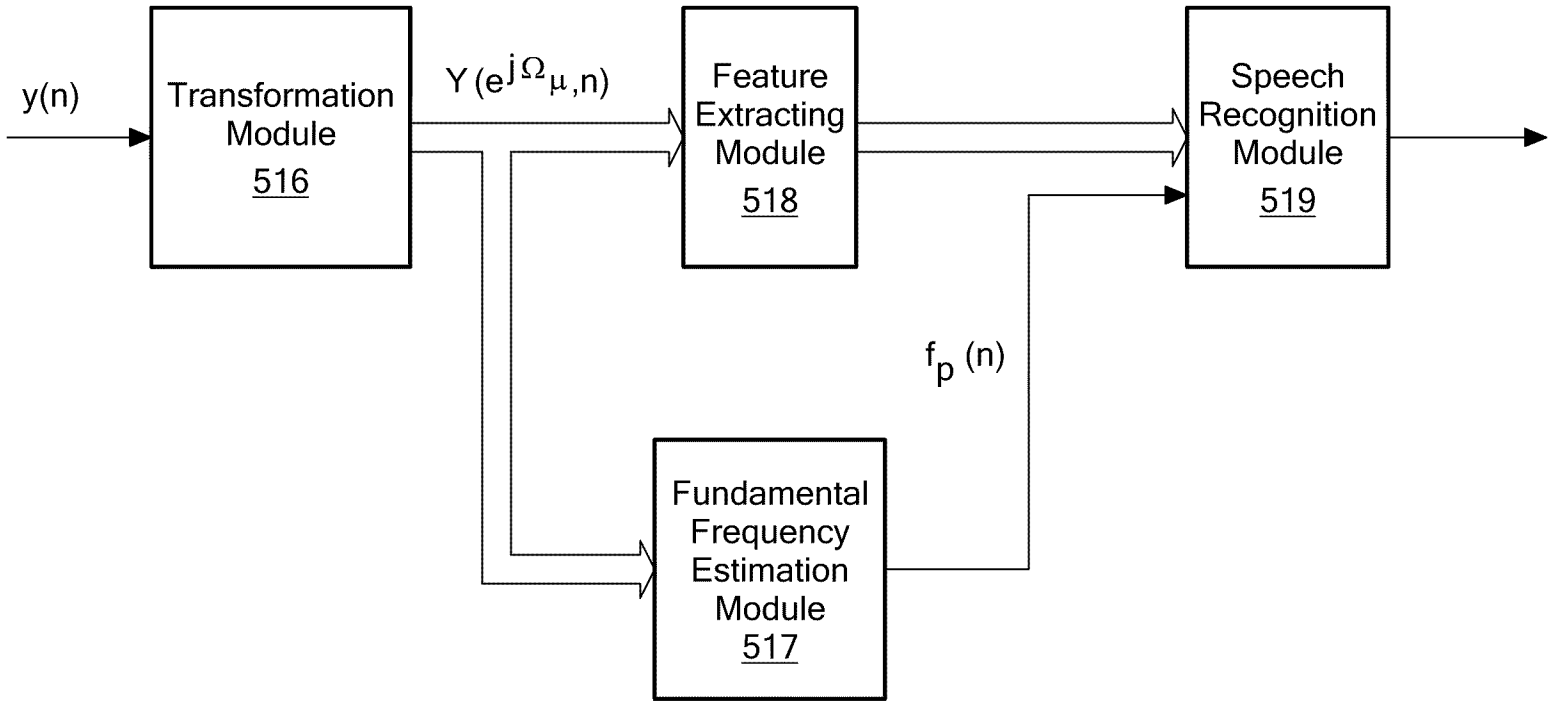
FIG. 5 shows an example for an application of a fundamental frequency estimation.

Another system using a fundamental frequency estimating apparatus is shown in FIG. 5. In particular, FIG. 5 shows a system for automatic speech recognition. For this purpose, a transformation module 516 transforms a speech signal, y(n), into short-time spectra, $Y(e^{j\Omega_\mu},n)$. A fundamental frequency estimating apparatus 517 is used to estimate the fundamental frequency, $f_p(n)$. Further features of the speech signal are extracted by feature extracting module 518. Speech recognition module 519 yield a speech recognition result based on the estimated fundamental frequency and the features estimated by the feature estimating module 518. A reliable and/or robust estimation of the fundamental frequency can yield an improvement of the speech recognition system, in particular of the speech recognition accuracy.

Several methods are known for estimating a fundamental frequency of a speech signal. One method comprises determining a product of the absolute value of the frequency spectrum at equidistant sampling points. This method is termed Harmonic Product Spectrum Method (see e.g. M. R. Schroeder, "Period Histogram and Product Spectrum: New Method for Fundamental Frequency Measurements", J. Acoust. Soc. Am., 1968, Vol. 43, Nr. 4, pages 829-834).

An alternative method is based on modelling speech generation as a source-filter model. In particular, a fundamental frequency of the speech signal can be estimated in the Cepstral-domain.

Another method for estimating a fundamental frequency is based on a short-time auto-correlation function (see, e.g. A. de Cheveigne, H. Kawahara, "Yin, a Fundamental Frequency Estimator for Speech and Music", JASA, 2002, pages 1917-1930).

In the following, it is assumed that a speech signal is detected using at least one microphone. The speech signal, s(n), is often superimposed by a noise signal, b(n). A microphone signal, y(n), hence, may be composed of speech and noise, e.g.

$$y(n)=s(n)+b(n).$$

From the microphone signal, a short-time auto-correlation function in the time domain may be determined as follows:

$$\hat{r}_{yy}(m,n)=\frac{1}{L}\sum_{k=0}^{L-1}y(n-k)y(n-k+m).$$

Here m denotes the lag of the auto-correlation function. A direct estimation of the auto-correlation function from the microphone signal, however, may be time consuming.

Therefore, an estimate for a correlation function may be determined based on a signal spectrum, in particular, a short-time signal spectrum. One or more signal spectra may be received from a multi-rate system for speech signal processing, i.e. from a system using two or more sampling frequencies for processing a speech signal. One sampling frequency may be used for under-sampling of the speech signal. Determining a signal spectrum may be based on a predetermined sampling frequency, in particular on the sampling frequency used for under-sampling.

The receiving step may be preceded by determining a signal spectrum. In particular, a speech signal may be subdivided and/or windowed, in particular, to obtain overlapping frames of the speech signal (see, e.g. E. Hänsler, G. Schmidt, "Acoustic Echo and Noise Control—A Practical Approach", John Wiley & Sons, New Jersey, USA, 2004). A frame may correspond to a signal input vector. Depending on the order, N, used for the discrete Fourier Transform, a signal input vector of a frame of the speech signal may read:

$$\vec{y}(n)=[y(n),y(n-1),\ldots,y(n-N+1)]^T.$$

The upper index T denotes the transposition operation. Each signal input vector may be weighted using a window function, h:

$$\vec{h}=[h_0,h_1,\ldots,h_{N-1}]^T.$$

Using a discrete Fourier Transform, the weighted signal input vector may be transformed into the frequency domain, i.e.

$$Y(e^{j\Omega_\mu},n)=\sum_{k=0}^{N-1} y(n-k)h_k e^{-j\Omega_\mu k}.$$

The frequency nodes or frequency sampling points, $\Omega_\mu$, may be equidistantly distributed in the frequency domain, i.e.:

$$\Omega_\mu=\frac{2\pi}{N}\mu$$

where $\mu\in\{0,\ldots,N-1\}$.

Figure 3:
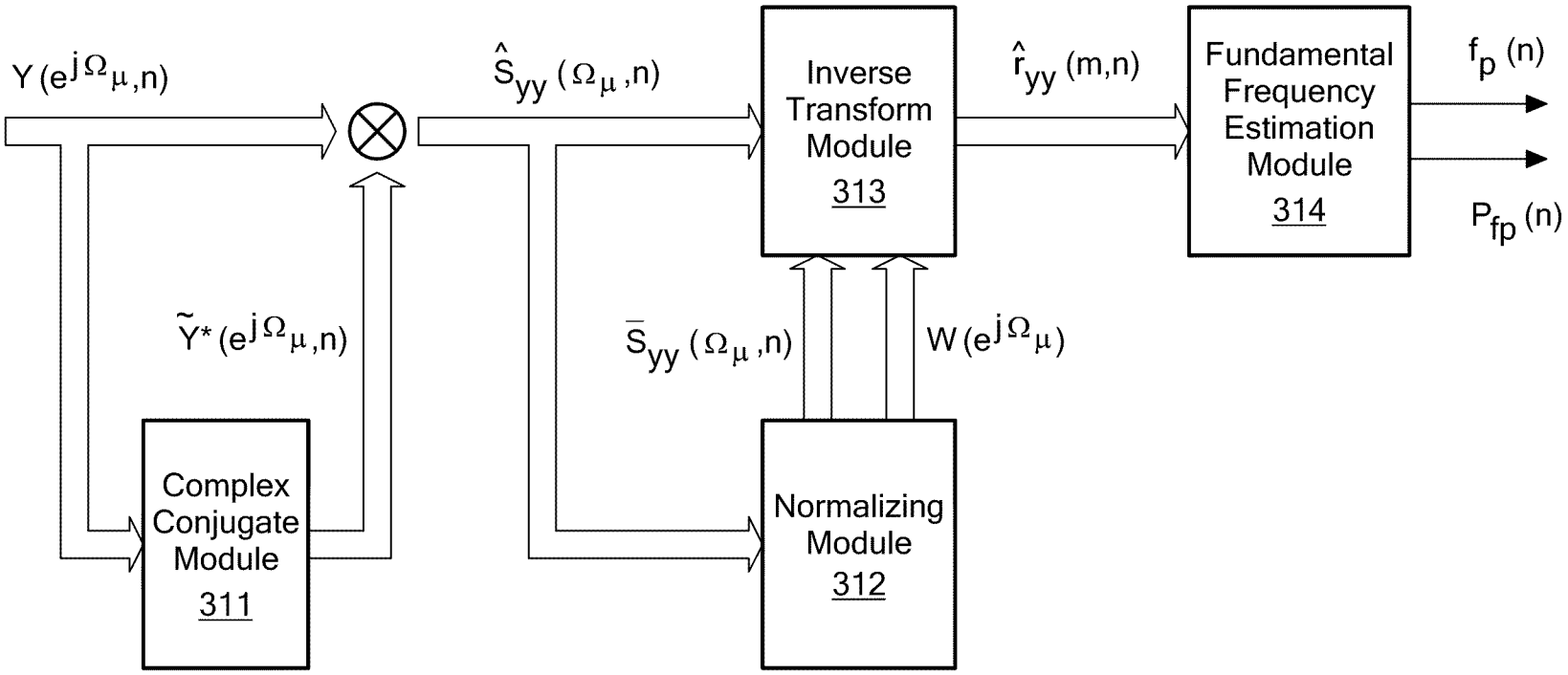
FIG. 3 illustrates a method for estimating a fundamental frequency using a plurality of modules.

FIG. 3 illustrates a method for estimating a fundamental frequency. From the signal spectrum, a power spectral density may be determined:

$$\hat{S}_{yy}(\Omega_\mu,n)=|Y(e^{j\Omega_\mu},n)|^2=Y(e^{j\Omega_\mu},n)Y^*(e^{j\Omega_\mu},n).$$

Here $Y^*(e^{j\Omega_\mu},n)$ denotes the complex conjugate of the signal spectrum, which may be determined by complex conjugate module 311.

The power spectral density may be smoothed in the frequency domain and subsequently divided by the envelope of the power spectral density obtained by smoothing. In this way, the envelope may be removed from the power spectral density. Smoothing the power spectral density may read:

$$\tilde{S}_{yy}(\Omega_\mu,n)=\begin{cases}\hat{S}_{yy}(\Omega_\mu,n) & \text{for } \mu=0,\\ \lambda\tilde{S}_{yy}(\Omega_{\mu-1},n)+(1-\lambda)\hat{S}_{yy}(\Omega_\mu,n) & \text{for } \mu\in\{1,\ldots,N-1\},\end{cases}$$

and $$\bar{S}_{yy}(\Omega_\mu,n)=\begin{cases}\tilde{S}_{yy}(\Omega_\mu,n) & \text{for } \mu=N-1,\\ \lambda\bar{S}_{yy}(\Omega_{\mu+1},n)+(1-\lambda)\tilde{S}_{yy}(\Omega_\mu,n) & \text{for } \mu\in\{0,\ldots,N-2\}.\end{cases}$$

A smoothing constant $\lambda$ may be chosen from a predetermined range. The smoothed and normalized power spectral density may be weighted using a power spectral density weight function, W:

$$\hat{S}_{yy,norm}(\Omega_\mu,n)=\frac{\hat{S}_{yy}(\Omega_\mu,n)}{\bar{S}_{yy}(\Omega_\mu,n)}W(e^{j\Omega_\mu}).$$

Smoothing and weighting the power spectral density may be performed by normalizing module 312.

By transforming the power spectral density into the time domain, in particular using inverse transformation module 313, an auto-correlation function may be obtained, i.e.

$$\hat{r}_{yy}(m,n)=\frac{1}{N}\sum_{\mu=0}^{N-1}\hat{S}_{yy,norm}(\Omega_\mu,n)e^{j\frac{2\pi}{N}\mu m}.$$

From the auto-correlation function, a fundamental frequency of the speech signal may be estimated using estimating module 314.

Figure 8:
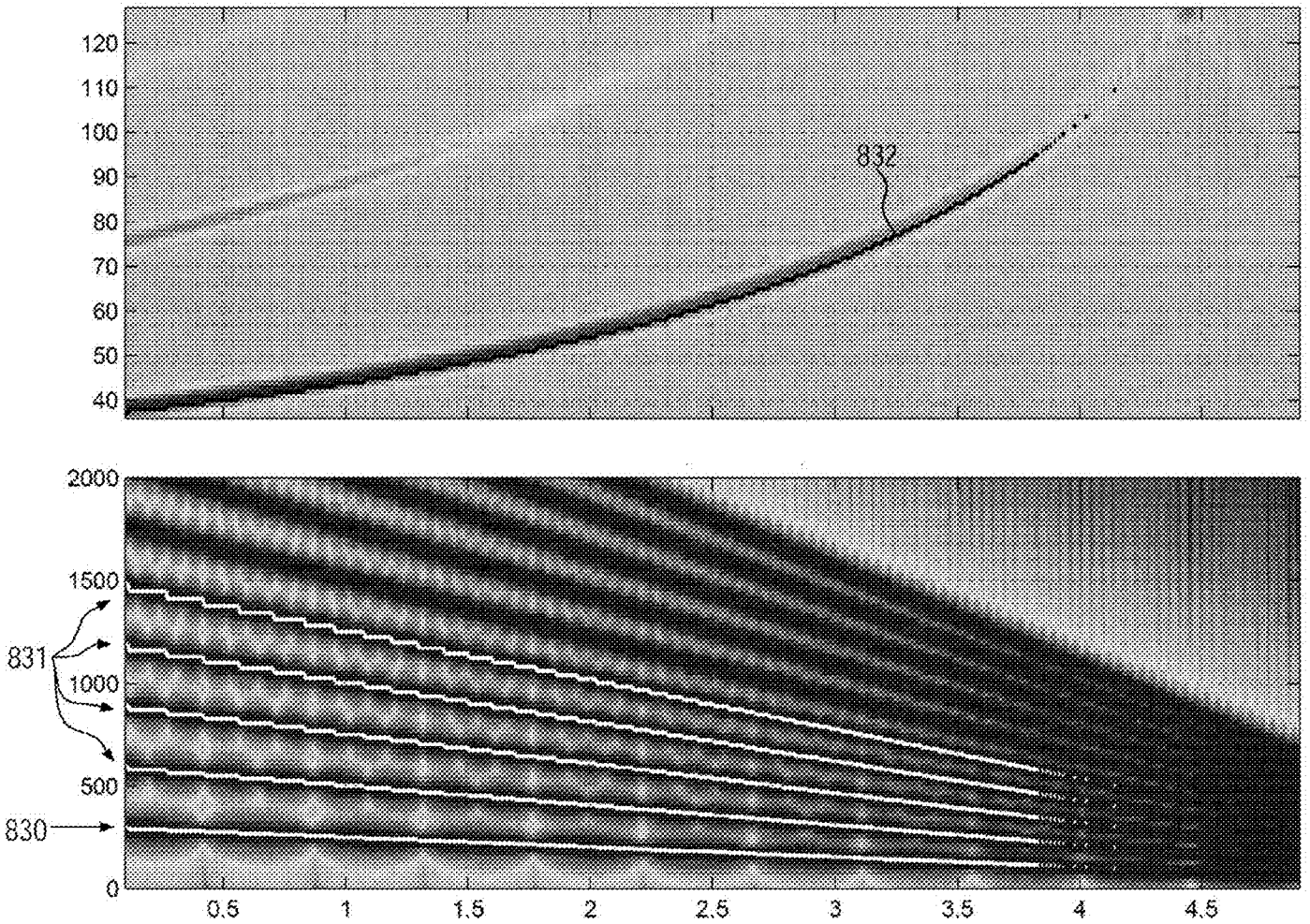
FIG. 8 shows a spectrogram and an analysis of an auto-correlation function.

FIG. 8 shows a spectrogram and an analysis of the auto-correlation function of a speech signal. In this case, the auto-correlation function was determined using a method, as described above in context of FIG. 3. The x-axis shows the time in seconds and the y-axis shows the frequency in Hz in the lower panel and the lag in number of sampling points in the upper panel, respectively. The white solid lines in the lower panel of FIG. 8 indicate estimates of the fundamental frequency 830 and its harmonics 831, in particular wherein the difference between two subsequent or adjacent white lines corresponds to the (time-dependent) fundamental frequency of the speech signal. The black solid line 832 in the upper panel indicates the lag of the auto-correlation function corresponding to the estimated fundamental frequency.

The speech signal corresponds to a combination, in particular a superposition, of 10 sinusoidal signals with equal amplitude. The frequencies of the sinusoidal signals were chosen equidistantly in the frequency domain. In particular, initially a fundamental frequency of 300 Hz was chosen, which was decreased linearly with time down to a frequency of 60 Hz. The order of the discrete Fourier Transform used in this example was N=256, the sampling frequency of the speech signal was 11025 Hz and the auto-correlation function was analyzed in a lag range between m=40 and m=128. It can be seen that a fundamental frequency down to 120 Hz can be estimated using this method, while lower fundamental frequencies (below 120 Hz) could not be reliably estimated.

Figure 4:
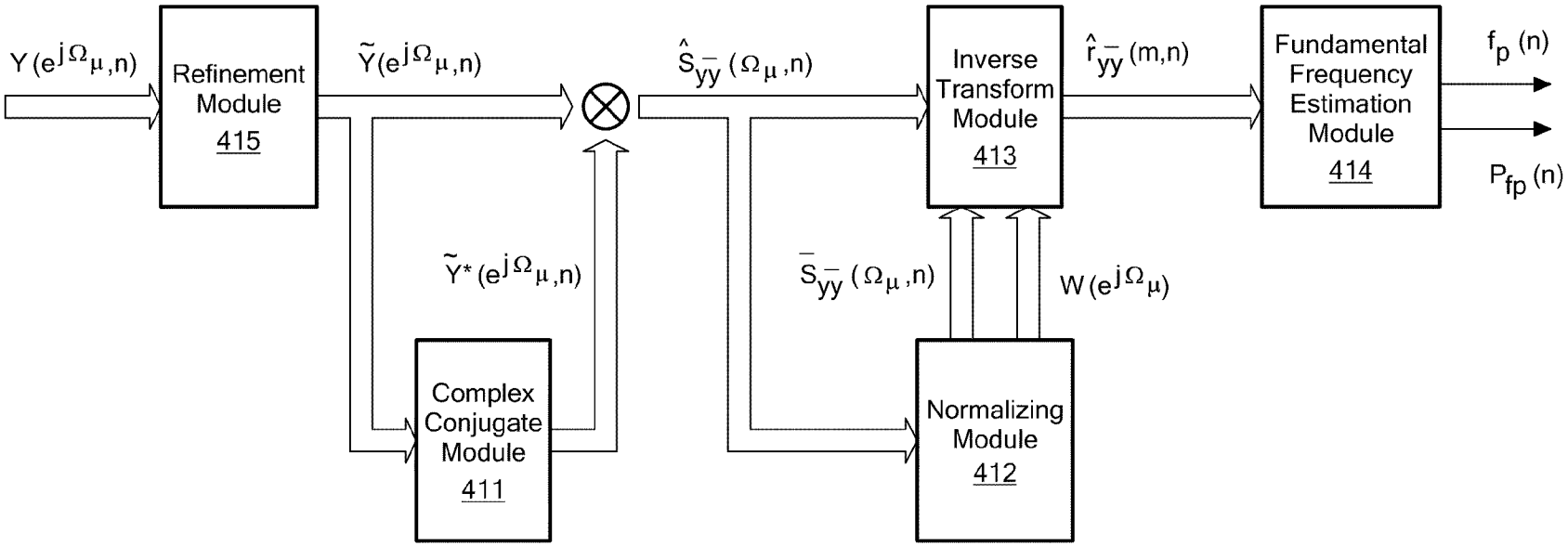
FIG. 4 illustrates a method for estimating a fundamental frequency based on an auto-power spectral density of a refined signal spectrum using a plurality of modules.

In FIG. 4, another method for estimating a fundamental frequency of a speech signal is illustrated. The method illustrated in FIG. 4 differs from the method of FIG. 3 in that the signal spectrum is spectrally refined before calculating the power spectral density. In other words, an auto-power spectral density is calculated from a refined signal spectrum. The spectral refinement may be performed using refinement module 415. The spectral refinement, however, can introduce a significant signal delay in the signal path. Complex conjugate module 411 may determine a complex conjugate of a refined signal spectrum. Smoothing and weighting of the auto-power spectral density may be performed by normalizing module 412. By transforming the auto-power spectral density into the time domain, in particular using inverse transformation module 413, an auto-correlation function may be obtained. From the auto-correlation function, a fundamental frequency of the speech signal may be estimated using estimating module 414.

Figure 9:
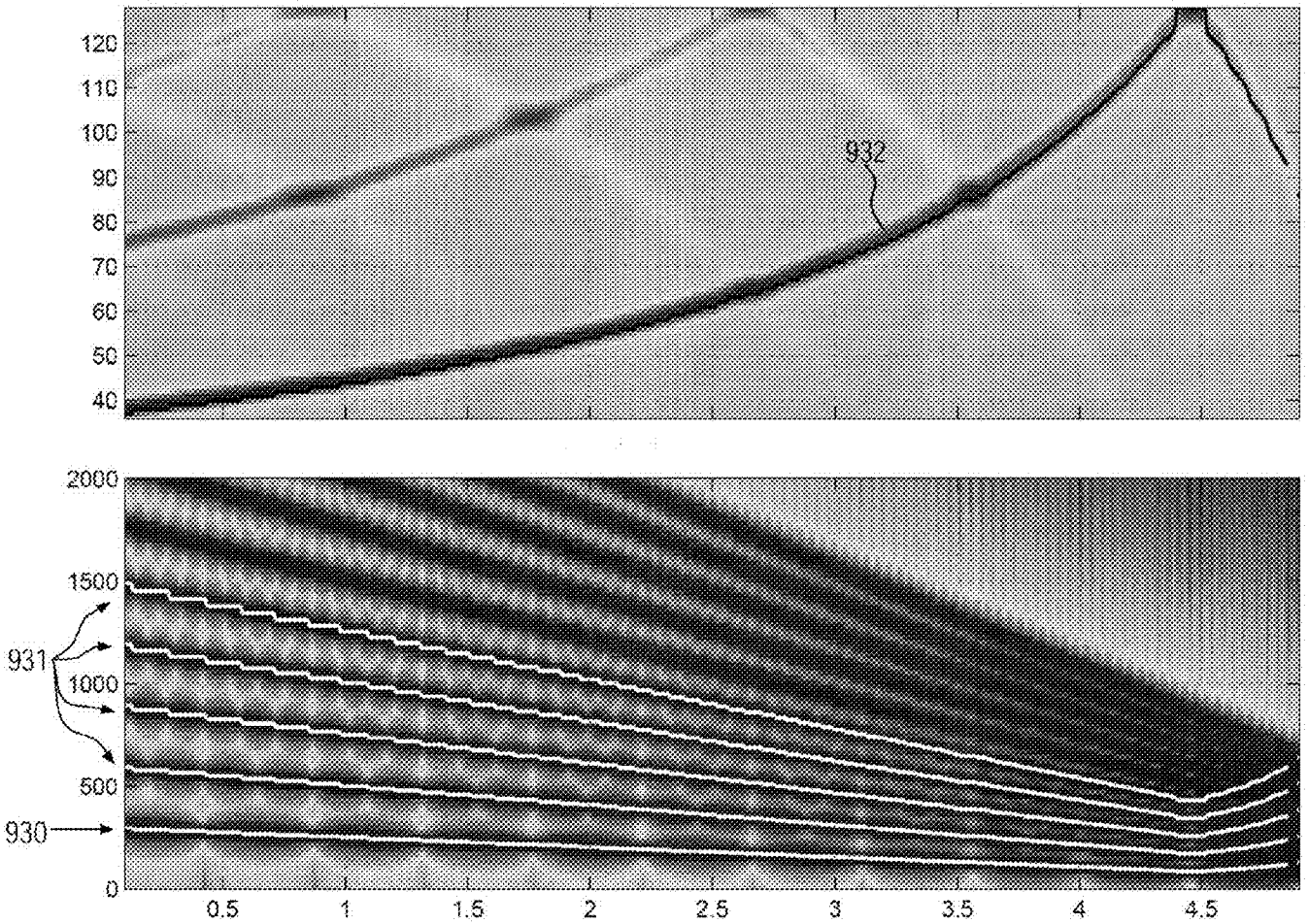
FIG. 9 shows a spectrogram and an analysis of an auto-correlation function based on a refined signal spectrum.

FIG. 9 shows an analysis of the auto-correlation function based on a refined signal spectrum, as described in context of FIG. 4, in the upper panel, and a spectrogram of the signal spectrum in the lower panel. The x-axis shows the time in seconds and the y-axis shows the frequency in Hz in the lower panel and the lag in number of sampling points in the upper panel, respectively. The parameters underlying the speech signal used for this analysis were chosen as described above in context of FIG. 8. For the spectral refinement, a frame shift of r=64 was used. It can be seen that the fundamental frequency can be reliably estimated up to a shift of m=128, which corresponds, in this example, to a fundamental frequency of 90 Hz, For lower frequencies, however, the estimate of the fundamental frequency 930, as indicated by the lowest of the white lines, differs from the true fundamental frequency which continues to decrease to lower frequencies down to 60 Hz. Furthermore, FIG. 9 shows harmonics 931 of the fundamental frequency. The black solid line 932 in the upper panel indicates the lag of the auto-correlation function corresponding to the estimated fundamental frequency.

Figure 1:
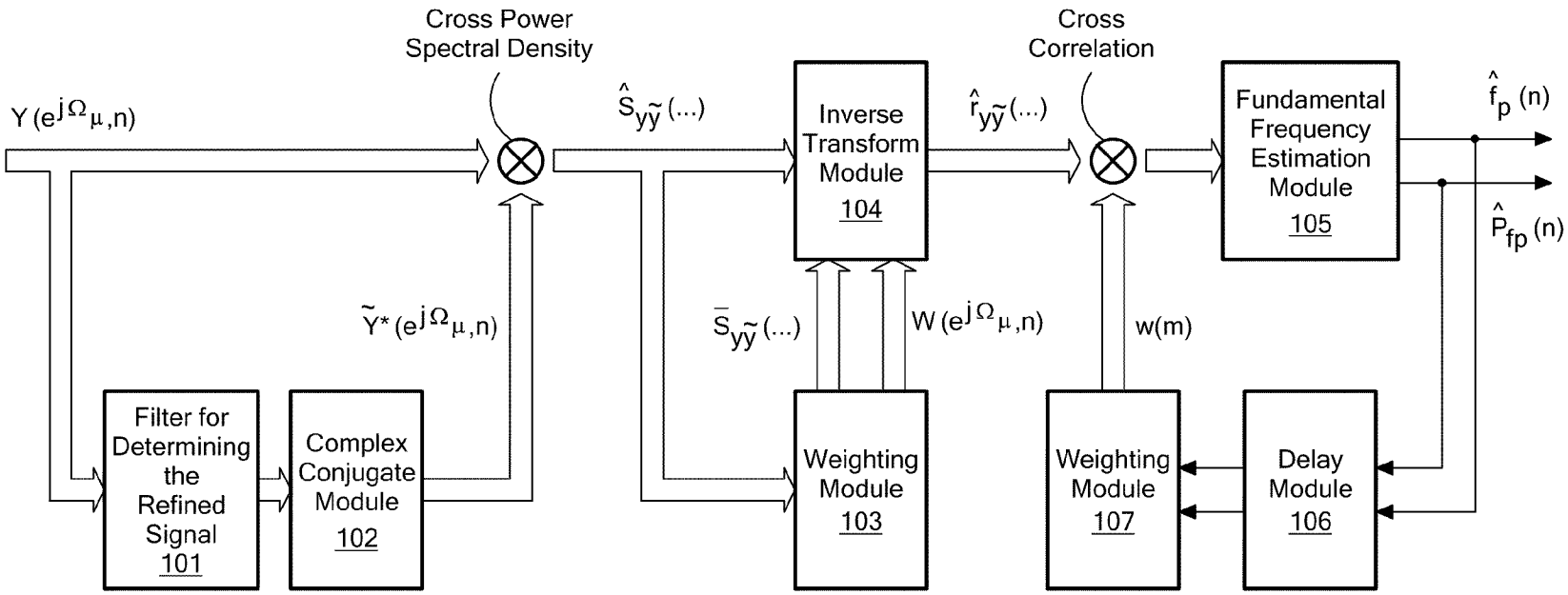
FIG. 1 illustrates a method for estimating a fundamental frequency of a speech signal using a plurality of modules.

In FIG. 1, a method for estimating a fundamental frequency of a speech signal is illustrated. In this case, a cross-power spectral density is estimated or determined based on a signal spectrum, $Y(e^{j\Omega_\mu},n)$, and a refined signal spectrum, $\tilde{Y}(e^{j\Omega_\mu},n)$, wherein the refined signal spectrum corresponds to a spectrally refined or augmented signal spectrum. The parameter μ denotes here the μ-th sampling point of the signal spectrum and of the refined signal spectrum. However, the number of frequency nodes of the refined signal spectrum is higher than the number of frequency nodes of the signal spectrum. The cross-power spectral density may be calculated as:

$$\begin{aligned}\hat{S}_{y\tilde{y}}(\Omega_\mu, n) &= Y(e^{j\Omega_\mu}, n)\tilde{Y}^*(e^{j\Omega_\mu}, n)\\ &= Y(e^{j\Omega_\mu}, n)\left[\sum_{m'=0}^{M-1} g_{\mu,m'} Y(e^{j\Omega_\mu}, n-m')\right]^*.\end{aligned}$$

Here, $g_{\mu,m'}$ denote the FIR filter coefficients of a sub-band. A set of filter coefficients may read:

$$g_\mu=[g_{\mu,0},g_{\mu,1},\ldots,g_{\mu,M-1}]^T.$$

The filter order of the FIR filter is denoted by the parameter M which may take a value in the range between 3 and 5. For a predetermined sub-band, a refined signal spectrum may be written as:

$$\tilde{Y}(e^{j\Omega_\mu},n)=g_{\mu,0}Y(e^{j\Omega_\mu},n)+\ldots+g_{\mu,M-1}Y(e^{j\Omega_\mu},n-(M-1)r).$$

Here the parameter r denotes a frame shift. In particular, time delayed signal spectra, $Y(e^{j\Omega_\mu}, n-m'r)$, may be obtained by time delay filtering of the signal spectrum, with $m'\in\{0,M-1\}$. Details on the filtering procedure, in particular on the choice of the filter coefficients, can be found in "Spectral refinement and its Application to Fundamental Frequency Estimation", by M. Krini and G. Schmidt, Proc. IEEE WASPAA, Mohonk, N.Y., 2007.

The filtering may be performed by filtering module 101. From the refined signal spectrum the complex conjugate may be determined, in particular using complex conjugate module 102.

By determining a cross-power spectral density of the refined signal spectrum and the signal spectrum following differences compared to the determination of an auto-power spectral density of a refined signal spectrum may occur. First of all, no additional delay is inserted into the signal path. The cross-correlation function estimated based on the cross-power spectral density may have a maximum value at the group delay of the employed filter. For a phase linear filter, the lag corresponding to the group delay may correspond to $$\frac{M-1}{2}r$$

sampling points. In other words, a maximum expected for an auto-correlation function at a lag of zero, may be shifted for the cross-correlation function to a lag corresponding to the group delay of the filter used for filtering the signal spectrum.

Furthermore, a cross-power spectral density is usually a complex valued function. In contrast to this, an auto-power spectral density is usually a real valued function. Therefore, compared to prior art methods, the amount of available information may be doubled using the cross-power spectral density. Therefore, even if filtering the signal spectrum comprises only a time-delay filtering of the signal spectrum, the estimation of the fundamental frequency can be improved by increasing, for example, doubling, the amount of available information. The cross-power spectral density may be symmetric to Ω=π.

The cross-power spectral density may be normalized and weighted with a predetermined cross-power spectral density weight function, $W(e^{j\Omega_\mu})$. In particular, the normalization may be determined based on the absolute value of the determined cross-power spectral density, i.e.

$$\hat{S}_{y\tilde{y},norm}(\Omega_\mu, n) = \frac{\hat{S}_{y\tilde{y}}(\Omega_\mu, n)}{\bar{S}_{y\tilde{y}}(\Omega_\mu, n)} W(e^{j\Omega_\mu}), \text{ with}$$

$$\bar{S}_{y\tilde{y}}(\Omega_\mu, n) = \begin{cases} \tilde{S}_{y\tilde{y}}(\Omega_\mu, n) & \text{for } \mu = N-1 \\ \lambda\bar{S}_{y\tilde{y}}(\Omega_{\mu+1}, n) + (1-\lambda)\tilde{S}_{y\tilde{y}}(\Omega_\mu, n) & \text{for } \mu \in \{0, \ldots, N-2\} \end{cases}$$

and $$\tilde{S}_{y\tilde{y}}(\Omega_\mu, n) = \begin{cases} \left|\hat{S}_{y\tilde{y}}(\Omega_\mu, n)\right| & \text{for } \mu = 0, \\ \lambda\tilde{S}_{y\tilde{y}}(\Omega_{\mu-1}, n) + (1-\lambda)\left|\hat{S}_{y\tilde{y}}(\Omega_\mu, n)\right| & \text{for } \mu \in \{1, \ldots, N-1\}. \end{cases}$$

The smoothing constant λ may be chosen from a predetermined interval, in particular, between 0.3 and 0.7. The weighting and normalizing may be performed using the cross-power spectral density weighting module 103.

The cross-power spectral density may be transformed into the time domain as $$\hat{r}_{y\tilde{y},pre}(m, n) = \frac{1}{N}\sum_{\mu=0}^{N-1} \hat{S}_{y\tilde{y},norm}(\Omega_\mu, n) e^{j\frac{2\pi}{N}\mu m},$$

thereby obtaining an estimate for a cross-correlation function. The Inverse Discrete Fourier Transform may be implemented as Inverse Fast Fourier Transform, in order to improve the computational efficiency. The transformation may be performed by inverse transformation module 104.

The cross-correlation function may be determined for a predetermined number of sampling points, which correspond to a predetermined number of discrete values of the lag variable, m. For example, if an inverse Fast Fourier Transform is used for transforming the cross-power spectral density into the time domain, the predetermined number may correspond to the order of the Fourier Transform.

In order to compensate for a delay or shift introduced by filtering the signal spectrum into the cross-correlation function, the cross-correlation function may be modified as:

$$\hat{r}_{y\tilde{y}}(m,n)=\hat{r}_{y\tilde{y},pre}((m+R)\bmod N,n).$$

The parameter R denotes the shift, in particular, in form of a number of sampling points associated with the shift or delay, introduced by filtering the signal spectrum. The expression "mod" denotes the modulo operation. After this correction, the value of the cross-correlation function at a lag of zero corresponds to a maximum and the cross-correlation function of a periodic signal with a period P may have local maxima at integer multiples of P. In other words, after compensating for the delay, the cross-correlation function may have similar properties as an auto-correlation function. This modification may be performed by the inverse transformation module 104.

Subsequently, the cross-correlation function may be weighted using a set of weights, w(n), with $$w(n)=[w(0,n),\ldots,w(m,n),\ldots,w(N-1,n)]^T,$$

and the weighted cross-correlation function may be normalized to its value at a lag of zero, i.e.

$$\hat{r}_{y\tilde{y},mod}(m,n)=\frac{\hat{r}_{y\tilde{y}}(m,n)w(m,n)}{\hat{r}_{y\tilde{y}}(0,n)}.$$

The weighting may be performed by weighting module 107. The weighting module 107 may use a fundamental frequency estimate from a previous frame, in particular from a previous adjacent frame. Delay module 106 may be used for delaying a fundamental frequency estimate, $\hat{f}_p(n)$, and/or a confidence measure, $\hat{p}_{f_p}(n)$, e.g. by one frame as determined in the fundamental frequency estimation module 105.

The weights from the set of weights may correspond to discrete values of a weight function, w(m,n), evaluated for sampling points m of the cross-correlation function. The weight function may comprise a bias term compensating for a bias of the estimation of the fundamental frequency, in particular, wherein the bias term is time independent, and a time dependent term. In particular, the weight function may be a combination, in particular a product, of a bias term and a time dependent term, i.e.

$$w(m,n)=w_b(m)w_p(m,n).$$

Figure 2:
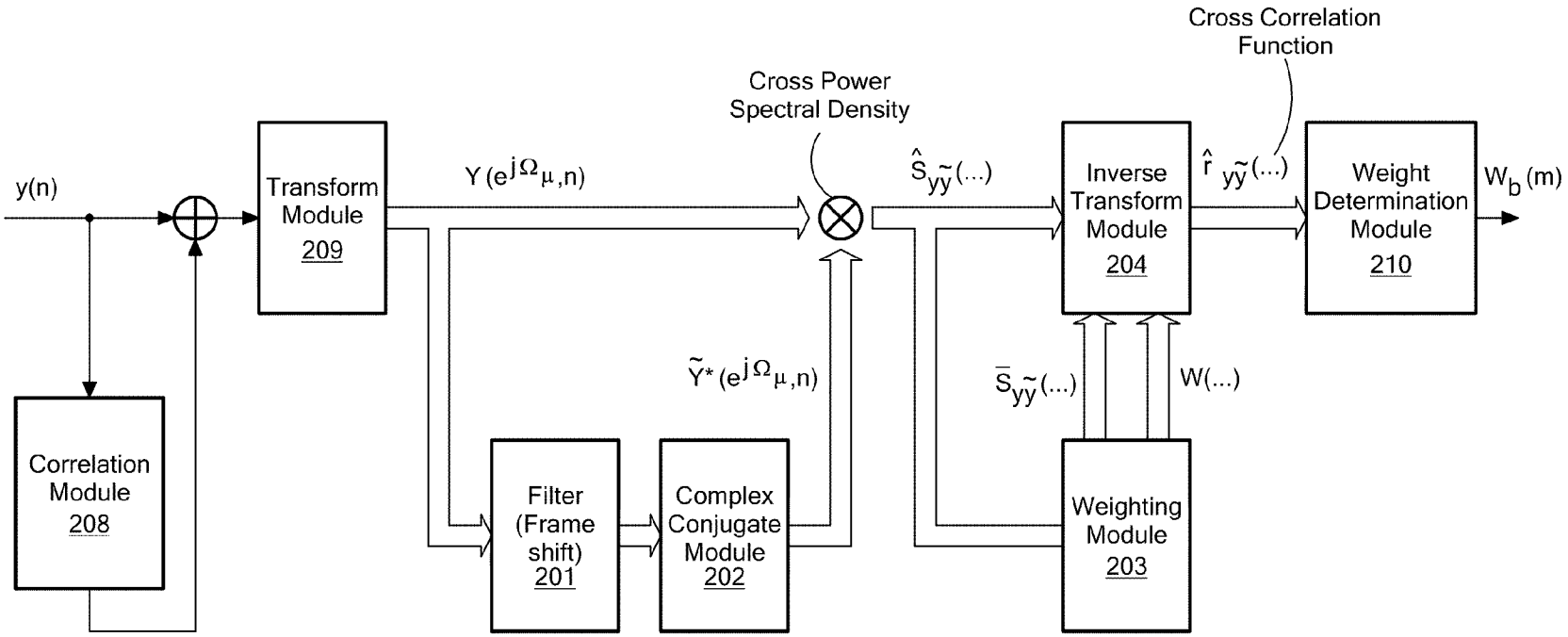
FIG. 2 illustrates a method for estimating a weight function using a plurality of modules.

FIG. 2 illustrates a method for estimating a bias term of the weight function. White noise, in particular, Gaussian distributed white noise may be correlated using correlation module 208 and transformed into the frequency domain by transformation module 209. Correlating the white noise may comprise a time-delay filtering of the white noise. A cross-correlation function may be determined for each of a plurality of frames of the correlated white noise as described above for the signal spectrum and the refined signal spectrum. In particular, a signal spectrum of the correlated white noise may be filtered by filtering module 201 and complex conjugated using complex conjugate module 202. The filtering module produces an refined signal spectrum. A determined cross-power spectral density may be normalized and weighted using cross-power spectral density weighting module 203. Inverse transformation module 204 may be used to transform the determined cross-power spectral density into the time domain thereby obtaining a cross-correlation function.

A time average over the cross-correlation functions may be determined as $$\overline{\hat{r}_{y\tilde{y}}(m)}=\frac{1}{N_{av}}\sum_{n=0}^{N_{av}-1}\hat{r}_{y\tilde{y}}(m,n).$$

The parameter $N_{av}$ may define the number of frames for which the time average is calculated. The parameter $N_{av}$ may be determined as $$N_{av}=\left\lceil\frac{3\ \text{seconds}\ f_s}{r}\right\rceil,$$

where $f_s$ denoted the sampling frequency of the correlated white noise and r denotes the frame shift introduced by the filtering step. The operator ⌈ ⌉ denotes a round-up operator configured to round its argument up to the next higher integer.

The bias term of the weight function may be determined, in particular using a weight function determining module 210, as $$w_b(m)=\min\left\{w_{max},\frac{\overline{\hat{r}_{y\tilde{y}}(m)}}{\overline{\hat{r}_{y\tilde{y}}(0)}}\right\},$$

where $w_{max}$ denotes a maximum compensation value, which, for example, may take a value of $w_{max}=2$.

A time variable weight function or time variable term of a weight function may be a product or a combination of two terms or factors:

$$w_p(m,n)=w_{p,mean}(m,n)w_{p,curr}(m,n)$$

A mean fundamental frequency term, $w_{p,mean}(m,n)$, may be based on an average fundamental frequency and a current fundamental frequency term, $w_{p,curr}(m,n)$, may be based on a predetermined fundamental frequency estimate of a previous, in particular adjacent previous, frame.

The mean fundamental frequency term, $w_{p,mean}(m,n)$, of the weight function based on an average fundamental frequency of previous frames may be determined as $$w_{p,mean}(m,n)=\begin{cases}\max\left\{\begin{matrix}w_{p,min},\\ w_{p,mean}(m+1,n)b_{mean}\end{matrix}\right\} & \text{for } m<0.8\overline{\tau_p(n-1)}\\ 1 & \text{for } 0.8\overline{\tau_p(n-1)}\le m\le 1.2\overline{\tau_p(n-1)}\\ \max\left\{\begin{matrix}w_{p,min},\\ w_{p,mean}(m-1,n)b_{mean}\end{matrix}\right\} & \text{otherwise}\end{cases}$$

Here, the parameter $b_{mean}$ determines the decrease, in particular the linear decrease, of the weight function outside a range of lag values comprising the lag associated with the mean fundamental frequency. In particular, the parameter $b_{mean}$ may be constant and may be determined from a range between 0.9 and 0.98. A predetermined lower boundary value $w_{p,min}$ may be chosen to be 0.3.

The period associated with a fundamental frequency at a given time, i.e. for a predetermined frame n, may be estimated, in particular using estimating module 105, as $$\tau_p(n) = \underset{m_1 \le m \le m_2}{\operatorname{argmax}} \{\hat{r}_{y\tilde{y},mod}(m, n)\}.$$

Here $m_1$ and $m_2$ denote the lower and upper boundary values, respectively, of a lag range in which a maximum of the cross-correlation function is searched. For instance, $m_1$ may take a value of 30 and $m_2$ may take a value of 180, which may correspond to approximately 367 Hz and 60 Hz, respectively, for a predetermined sampling frequency of 11025 Hz.

The mean period, $\overline{\tau_p(n)}$, associated with a mean fundamental frequency at time n, may be estimated as $$\overline{\tau_p(n)} = \begin{cases} \beta_\tau \overline{\tau_p(n-1)} + (1-\beta_\tau)\tau_p(n) & \text{if } \dfrac{\hat{r}_{y\tilde{y}}(\tau_p(n), n) w_b(\tau_p(n))}{\hat{r}_{y\tilde{y}}(0, n)} > s_0 \\ \overline{\tau_p(n-1)} & \text{otherwise.} \end{cases}$$

Here, the mean period associated with the mean fundamental frequency is only modified if a confidence criterion is fulfilled, i.e. if $$\frac{\hat{r}_{y\tilde{y}}(\tau_P(n), n) w_b(\tau_P(n))}{\hat{r}_{y\tilde{y}}(0, n)} > s_0,$$

where $s_0$ denotes a threshold, in particular, wherein the threshold may be chosen from the interval between 0.4 and 0.5.

The current fundamental frequency term of the weight function based on a predetermined fundamental frequency estimate, in particular the fundamental frequency estimate of the previous, adjacent frame, may be determined as:

$$w_{p,curr}(m, n) = \begin{cases} \max\left\{ \begin{matrix} w_{p,min}, \\ w_{p,curr}(m+1, n) b_{curr} \end{matrix} \right\} & \text{for } m < 0.8\tau_p(n-1) \\ 1 & \text{for } 0.8\tau_p(n-1) \le m \le 1.2\tau_p(n-1) \\ \max\left\{ \begin{matrix} w_{p,min}, \\ w_{p,curr}(m-1, n) b_{curr} \end{matrix} \right\} & \text{otherwise} \end{cases}$$

Here, the parameter $b_{curr}$ determines the decrease, in particular the linear decrease, of the weight function outside a predetermined range of lag values comprising the lag associated with the predetermined fundamental frequency estimate. In particular, the parameter $b_{curr}$ may be constant and may be determined from a range between 0.95 and 0.995.

If no reliable estimate of the fundamental frequency was possible for the previous frame, i.e. if $$\frac{\hat{r}_{y\tilde{y}}(\tau_P(n-1), n-1)\omega_b(\tau_P(n-1))}{\hat{r}_{y\tilde{y}}(0, n-1)} < s_0$$

the current fundamental frequency term may be set to 1, i.e.

$$w_{p,curr}(m,n)=1.$$

From the period, $\tau_p(n)$, at a given time n, i.e. for a frame corresponding to the time n, the fundamental frequency may be estimated as:

$$f_p'(n) = \frac{f_s}{\tau_p(n)},$$

where $f_s$ denotes the sampling frequency of the speech signal. A confidence measure may be determined as $$\hat{p}_{f_p}(n) = \frac{\hat{r}_{y\tilde{y}}(\tau_P(n), n)\omega_b(\tau_P(n))}{\hat{r}_{y\tilde{y}}(0, n)}.$$

Alternatively, the confidence measure may read $$\hat{p}_{f_p}(n) = \frac{\hat{r}_{y\tilde{y}}(\tau_P(n), n)}{\hat{r}_{y\tilde{y}}(0, n)}.$$

A higher value of the confidence measure may indicate a more reliable estimate.

A fundamental frequency parameter, $f_p$, e.g. of a speech synthesis apparatus, may be set to the estimated fundamental frequency if the confidence measure exceeds a predetermined threshold. The predetermined threshold may be chosen between 0.2 and 0.5, in particular, between 0.2 and 0.3. For example, setting the fundamental frequency parameter may read:

$$f_P(n) = \begin{cases} f_p'(n) & \text{if } \hat{p}_{f_p}(n) > p_0 \\ F_p & \text{else.} \end{cases}$$

Here $F_p$ denotes a preset fundamental frequency value or a parameter indicating that the fundamental frequency may not be reliably estimated.

Figure 10:
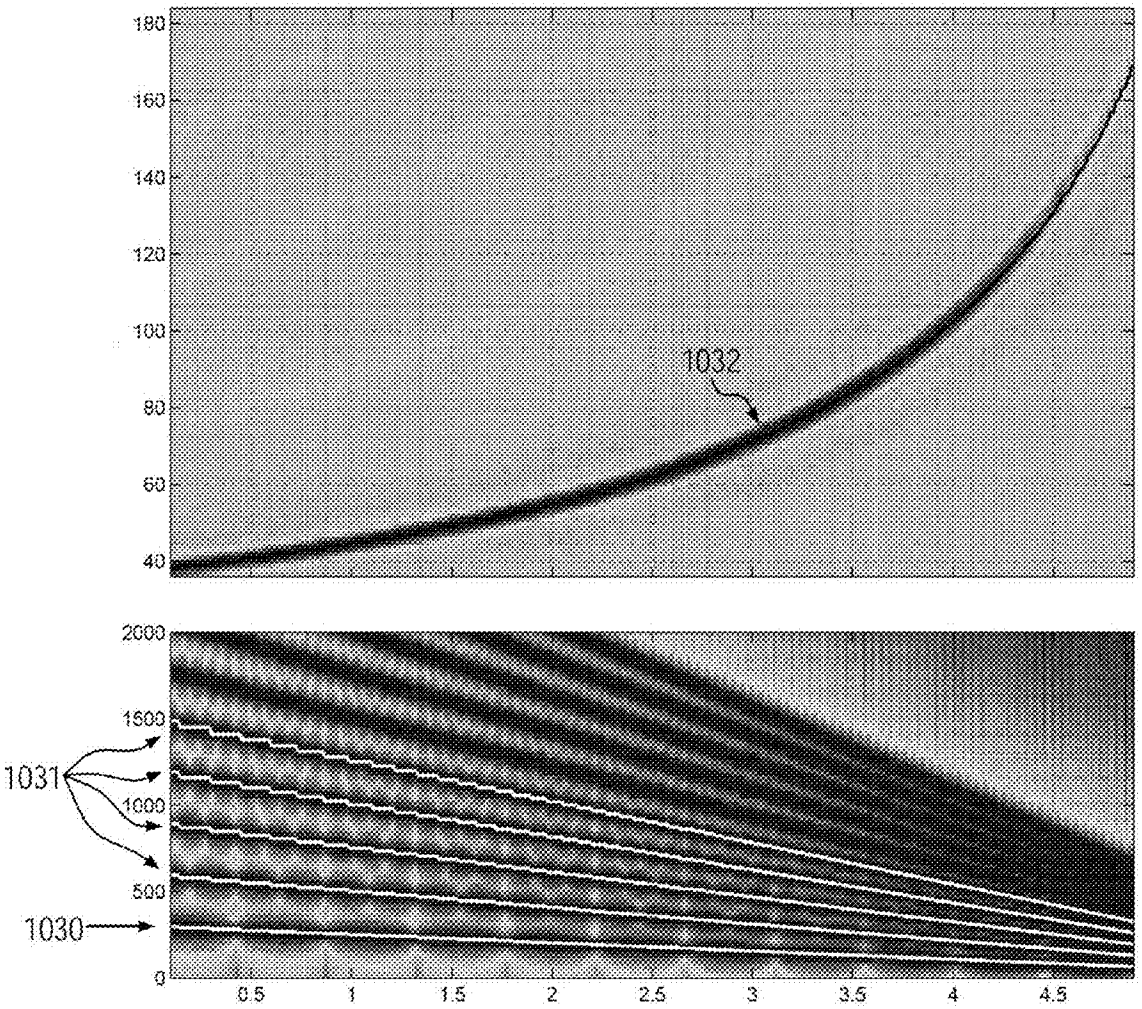
FIG. 10 shows a spectrogram and an analysis of a cross-correlation function based on a refined signal spectrum and a signal spectrum.

FIG. 10 shows a spectrogram and an analysis of a cross-correlation function based on a refined signal spectrum and a signal spectrum, as described in context of FIG. 1. The x-axis shows the time in seconds and the y-axis shows the frequency in Hz in the lower panel and the lag in number of sampling points in the upper panel, respectively. The parameters underlying the speech signal used for this analysis were chosen as described above in the context of FIGS. 8 and 9. For the spectral refinement, a frame shift of r=64 was used. It can be seen that the fundamental frequency can be well estimated, in particular also at low fundamental frequencies. Again the lowest white line 1030 indicates the estimate of the fundamental frequency and the black solid line 1032 indicates the corresponding lag of the cross-correlation function. Furthermore the harmonics 1031 of the fundamental frequency are shown in the lower panel.

Although the previously discussed embodiments of the present invention have been described separately, it is to be understood that some or all of the above described features can also be combined in different ways. The discussed embodiments are not intended as limitations but serve as examples illustrating features and advantages of the invention. The embodiments of the invention described above are intended to be merely exemplary; numerous variations and modifications will be apparent to those skilled in the art. All such variations and modifications are intended to be within the scope of the present invention as defined in any appended claims.

It should be recognized by one of ordinary skill in the art that the foregoing methodology may be performed in a signal processing system and that the signal processing system may include one or more processors for processing computer code representative of the foregoing described methodology. The computer code may be embodied on a tangible computer readable medium i.e. a computer program product. Additionally, the modules referred to above with respect to the Figs. may be embodied as hardware (e.g. circuitry) or the modules may be embodied as software wherein the software is embodied on a tangible computer readable storage medium. Still further, the modules may be a combination of hardware and software wherein the modules may be combined together or may be separately executed on one or more processors capable of receiving and executing software code.

The present invention may be embodied in many different forms, including, but in no way limited to, computer program logic for use with a processor (e.g., a microprocessor, microcontroller, digital signal processor, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an embodiment of the present invention, predominantly all of the logic may be implemented as a set of computer program instructions that is converted into a computer executable form, stored as such in a computer readable medium, and executed by a microprocessor under the control of an operating system.

Computer program logic implementing all or part of the functionality previously described herein may be embodied in various forms, including, but in no way limited to, a source code form, a computer executable form, and various intermediate forms (e.g., forms generated by an assembler, compiler, networker, or locator.) Source code may include a series of computer program instructions implemented in any of various programming languages (e.g., an object code, an assembly language, or a high-level language such as Fortran, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies, networking technologies, and internetworking technologies. The computer program may be distributed in any form as a removable storage medium with accompanying printed or electronic documentation (e.g., shrink wrapped software or a magnetic tape), preloaded with a computer system (e.g., on system ROM or fixed disk), or distributed from a server or electronic bulletin board over the communication system (e.g., the Internet or World Wide Web.)

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL.).

What is claimed is:

1. A computer implemented method for estimating a fundamental frequency of a speech signal comprising:

receiving within a processor a signal spectrum of the speech signal;

filtering the signal spectrum within the processor to obtain a refined signal spectrum with an increased spectral resolution;

computing a cross-power spectral density from an equation including a product of a first element as the refined signal spectrum and a second element as the unrefined signal spectrum;

transforming the cross-power spectral density into the time domain to obtain a cross-correlation function; and estimating the fundamental frequency of the speech signal based on the cross-correlation function.

2. The computer implemented method according to claim 1, wherein estimating the fundamental frequency comprises determining a maximum of the cross-correlation function.

3. The computer implemented method according to claim 2, wherein estimating the fundamental frequency comprises determining a lag of the cross-correlation function corresponding to the determined maximum of the cross-correlation function.

4. The computer implemented method according claim 1, wherein estimating the fundamental frequency comprises determining a weight function for the cross-correlation function and weighting the cross-correlation function with the determined weight function.

5. The computer implemented method according to claim 4, wherein the weight function comprises a bias term, wherein the bias term compensates for a bias of the estimation of the fundamental frequency.

6. The computer implemented method according to claim 5, wherein determining the bias term of the weight function is based on one or more cross-correlation functions of correlated white noise.

7. The computer implemented method according to claim 2, wherein the speech signal comprises a sequence of frames, and wherein the signal spectrum is a signal spectrum of a frame of the speech signal.

8. The computer implemented method according to claim 7, wherein the weight function comprises a mean fundamental frequency term, wherein determining the mean fundamental frequency term is based on a mean fundamental frequency, and/or a current fundamental frequency term, wherein determining the current fundamental frequency term is based on a predetermined fundamental frequency, wherein the predetermined fundamental frequency corresponds to a fundamental frequency estimate of a previous frame of the speech signal.

9. The computer implemented method according to claim 7, wherein determining the weight function comprises determining a combination of at least two terms of the group of terms comprising a current fundamental frequency term, a mean fundamental frequency term and a bias term.

10. The computer implemented method according to claim 1, wherein estimating the fundamental frequency comprises compensating the cross-correlation function for a shift or delay introduced by filtering the signal spectrum.

11. The computer implemented method according to claim 1, wherein estimating the fundamental frequency comprises determining a confidence measure for the estimated fundamental frequency.

12. The computer implemented method according to claim 1, wherein filtering the signal spectrum comprises augmenting the number of frequency nodes of the signal spectrum such that the number of frequency nodes of the refined signal spectrum is greater than the number of frequency nodes of the signal spectrum.

13. The computer implemented method according to claim 1, wherein the speech signal comprises a sequence of frames, and wherein the steps of the method are performed for the signal spectrum of each frame of the speech signal or for the signal spectrum of a plurality of frames of the speech signal.

14. A computer program product having a non-transitory computer readable storage medium having computer code thereon for estimating a fundamental frequency of a speech signal, the computer code comprising:

computer code for receiving a signal spectrum of the speech signal;

computer code for filtering the signal spectrum to obtain a refined signal spectrum with an increased spectral resolution;

computer code for computing a cross-power spectral density from an equation including a product of a first element as the refined signal spectrum and a second element as the unrefined signal spectrum;

computer code for transforming the cross-power spectral density into the time domain to obtain a cross-correlation function; and computer code for estimating the fundamental frequency of the speech signal based on the cross-correlation function.

15. The computer program product according to claim 14, wherein the computer code for estimating the fundamental frequency comprises computer code for determining a maximum of the cross-correlation function.

16. The computer program product according to claim 15, wherein the computer code for estimating the fundamental frequency comprises computer code for determining a lag of the cross-correlation function corresponding to the determined maximum of the cross-correlation function.

17. The computer program product according claim 14, wherein the computer code for estimating the fundamental frequency comprises computer code for determining a weight function for the cross-correlation function and weighting the cross-correlation function with the determined weight function.

18. The computer program product according to claim 17, wherein the weight function comprises a bias term, wherein the bias term compensates for a bias of the estimation of the fundamental frequency.

19. The computer program product according to claim 18, wherein the computer code for determining the bias term of the weight function is based on one or more cross-correlation functions of correlated white noise.

20. The computer program product according to claim 15, wherein the speech signal comprises a sequence of frames, and wherein the signal spectrum is a signal spectrum of a frame of the speech signal.

21. The computer program product according to claim 20, wherein the weight function comprises a mean fundamental frequency term, wherein determining the mean fundamental frequency term is based on a mean fundamental frequency, and/or a current fundamental frequency term, wherein determining the current fundamental frequency term is based on a predetermined fundamental frequency, wherein the predetermined fundamental frequency corresponds to a fundamental frequency estimate of a previous frame of the speech signal.

22. The computer program product according to claim 20, wherein the computer code for determining the weight function comprises computer code for determining a combination of at least two terms of the group of terms comprising a current fundamental frequency term, a mean fundamental frequency term and a bias term.

23. The computer program product according to claim 14, wherein estimating the fundamental frequency comprises compensating the cross-correlation function for a shift or delay introduced by filtering the signal spectrum.

24. The computer program product according to claim 14, wherein the computer code for estimating the fundamental frequency comprises computer code for determining a confidence measure for the estimated fundamental frequency.

25. The computer program product according to claim 14, wherein the computer code for filtering the signal spectrum comprises computer code for augmenting the number of frequency nodes of the signal spectrum such that the number of frequency nodes of the refined signal spectrum is greater than the number of frequency nodes of the signal spectrum.

26. The computer program product according to claim 14, wherein the speech signal comprises a sequence of frames, and wherein the steps of the method are performed for the signal spectrum of each frame of the speech signal or for the signal spectrum of a plurality of frames of the speech signal.

27. An apparatus for estimating a fundamental frequency of a speech signal comprising:

receiving module configured to receive a signal spectrum of the speech signal;

a filtering module comprising a processor configured to filter the signal spectrum to obtain a refined signal spectrum;

a determining module configured to compute a cross-power spectral density from an equation including a product of a first element as the refined signal spectrum and a second element as the unrefined signal spectrum;

a transforming module configured to transform the cross-power spectral density into the time domain to obtain a cross-correlation function; and an estimating module configured to estimate the fundamental frequency of the speech signal based on the cross-correlation function.

* * * * *